United States Patent [19]

Houck et al.

[11] Patent Number: 4,773,928

[45] Date of Patent: Sep. 27, 1988

[54] PLASMA SPRAY POWDERS AND PROCESS FOR PRODUCING SAME

[75] Inventors: David L. Houck, Towanda, Pa.; Richard F. Cheney, Norwalk, Conn.; James O. Steigelman, Athens, Pa.

[73] Assignee: GTE Products Corporation, Stamford, Conn.

[21] Appl. No.: 80,922

[22] Filed: Aug. 3, 1987

[51] Int. Cl.[4] ..... B22F 9/04

[52] U.S. Cl. ..... 75/0.5 R; 75/0.5 A; 75/0.5 AA; 75/0.5 B; 75/0.5 BA; 75/0.5 C; 75/10.19; 427/39

[58] Field of Search ..... 75/0.5 B, 0.5 BB, 10.19, 75/0.5 R; 429/39

[56] References Cited

U.S. PATENT DOCUMENTS

| | | | |
|---|---|---|---|
| 3,639,151 | 2/1972 | Krutenat | 427/39 |
| 3,865,722 | 2/1975 | Fisher et al. | 75/0.5 R |
| 3,877,930 | 4/1975 | Volin | 75/0.5 R |
| 4,025,334 | 5/1977 | Cheney et al. | 75/0.5 R |
| 4,070,184 | 1/1978 | Scheithauer, Jr. et al. | 75/0.5 B |
| 4,156,053 | 5/1979 | Baranow | 75/251 |
| 4,390,368 | 6/1983 | Houck | 75/251 |
| 4,507,189 | 3/1985 | Doi et al. | 427/39 |

OTHER PUBLICATIONS

"Low-Pressure-Plasma-Deposited Coatings Formed from Mechanically Alloyed Powders" by J. R. Rairden and E. M. Habesch of General Electric Corporate Research and Development, published in Thin Solid Films accepted Apr. 10, 1981.

*Primary Examiner*—Wayland Stallard
*Attorney, Agent, or Firm*—Donald R. Castle

[57] ABSTRACT

A process is disclosed for producing plasma type spray powders. The process involves forming, an admixture of a base metal, chromium, aluminum, and yttrium or master alloy powders containing these elements, and dry milling the admixture by high shearing to produce a homogeneous mixture. A slurry of this mixture and an aqueous solution of a binder is then spray dried to produce agglomerates, the major portion of which has a particle size of from about 20 to about 53 microns. This major portion is then separated from the remainder of the agglomerates and sintered in a reducing atmosphere to remove the binder and form a sintered powder. The sintered powder is then passed through a high temperature plasma reactor to melt the powder and produce a homogeneous plasma spray powder.

A plasma spray powder is disclosed which consists essentially of substantially spherical, melt solidified particles of from about 15 to about 44 microns in size, and having a weight composition of from about 14% to about 19% chromium, from about 10% to about 14% aluminum, from about 0.5% to about 1.0% yttrium and the balance a base metal selected from the group consisting of nickel, cobalt, iron and mixtures thereof.

7 Claims, No Drawings

PLASMA SPRAY POWDERS AND PROCESS FOR PRODUCING SAME

FIELD OF THE INVENTION

This invention relates to a process for producing plasma type spray powders and to the powder thus produced.

BACKGROUND OF THE INVENTION

Plasma type spray powder alloys of nickel, cobalt, chromium, aluminum, and yttrium are used extensively in the aircraft industry for high temperature corrosion resistant coatings. It is desirable that these powders be of from about 15 to about 44 microns in size and have uniform spherical shape for optimum processing.

These alloys are produced by conventional atomization processes from liquid melts. Because these materials require a low oxygen content, melting must be performed in an inert gas environment. Typical inert gas atomized powders have a rather broad particle size distribution. Therefore, the yield of in-size material which is usable for plasma spray applications is only a fraction of the powder atomized.

A process for forming alloy powders for plasma spray applications is disclosed in an article entitled "Low-Pressure Plasma-Deposited Coatings Formed From Mechanically Alloyed Powders" by J. R. Rairden and E. M. Habesch of General Electric Corporate Research and Development, published in "Thin Solid Films", accepted Apr. 10, 1981. The process of this article involves mechanical dry and wet milling of powders. Such mechanically produced alloys are not completely uniform in size. Furthermore, such alloy powders are irregular in shape.

Therefore, a process for producing a high yield of in-size particles of spherical shape and well alloyed composition for plasma spray applications would be an advancement in the art.

SUMMARY OF THE INVENTION

In accordance with one aspect of this invention, there is provided a process for producing plasma type spray powders. The process involves forming an admixture of a base metal, chromium, aluminum, and yttrium, or master alloy particles containing these elements, dry milling the admixture by high shearing to produce a homogeneous mixture. A slurry of this homogeneous mixture and an aqueous solution of a binder is then spray dried to produce agglomerates, the major portion of which has a particle size of from about 20 to about 53 microns. This 20 to 53 micron portion is then separated from the remainder of the agglomerates and sintered in a reducing atmosphere to remove the binder and form a sintered powder. The sintered powder is then passed through a high temperature plasma reactor to melt the powder and produce a homogeneous plasma spray powder.

In accordance with another aspect of this invention, there is provided a plasma spray powder consisting essentially of particles in percent by weight of from about 10% to about 50% chromium as a first metal, from about 1% to about 20% aluminum as a second metal, from about 0.5% to about 1.5% yttrium as a third metal, and the balance a base metal selected from the group consisting of nickel, cobalt, iron, and mixtures thereof, the metals being homogeneously distributed throughout each particle. The particles are substantially spherical and have a particle size of from about 15 to about 44 microns.

DETAILS OF THE PREFERRED EMBODIMENTS

For a better understanding of the present invention, together with other and further objects, advantages, and capabilities thereof, reference is made to the following disclosure and appended claims in connection with the foregoing description of some of the aspects of the present invention.

This invention relates to a process for producing plasma type spray powders and to the powder thus produced. An admixture of a base metal, chromium, aluminum, and yttrium is formed by blending. The base metal is preferably nickel, cobalt, iron or mixtures thereof. A typical composition of the admixture is as follows, by weight: from about 14% to about 19% chromium, from about 10% to about 14% aluminum, from about 0.5% to about 1.0% yttrium, and the balance cobalt. The cobalt and yttrium should be less than about 1.4 micron average FSSS, whereas the other materials can be as coarse as about −200 mesh. Alternatively, master alloy particles containing the desired proportion of the elements may be utilized. The admixture is then introduced into a high shear milling device, preferably an attritor mill. Milling is preferably dry without the aid of a liquid. Conditions are closely controlled by monitoring the temperature of the cooling fluid of the mill and the rate of rotation of the milling media. The preferred milling conditions with a 1S type Union Process attritor mill are from about 100 to about 200 rpm for about 18 to about 22 hours with from about 140 to about 160 rpm. The effect of this milling is to smear the individual particles together and shear them from one another. The ultimate mixture is one in which all of the remaining fine individual particles are homogenous and contain each of the components from which the initial admixture is made.

Alternatively, a mixture of fine (preferably less than about 2 micrometers in diameter) particles of each of the desired components can be mixed by any conventional means, such as ball milling or V-blending. A slurry is then formed of the resulting homogeneous mixture and an aqueous solution of a binder which is preferably polyvinyl alcohol, for example, Monsanto Gelvatol/type 20--30, or polyethylene glycol, known commercially as Carbowax. The specific gravity of the slurry is a value that allows maximum throughput in the subsequent spray drying operation without plugging the dryer nozzle. The slurry is then spray dried by conventional techniques to produce spray dried agglomerates which are held together by the binder. The major portion of the agglomerates, that is, from about 60% to about 70% by weight, has a particle size of from about 20 to about 53 microns, which is desirable for plasma spray applications after subsequent plasma densification.

The major in-size portion of the agglomerates, that is, the portion having a particle size of from about 20 to about 53 microns, is then separated from the remainder of the agglomerates or the out-size portion, by standard screening techniques. The major, or in-size portion, is then sintered as a powder, the particles of which have some degree of strength. Sintering temperatures are generally from about 750° C. to about 900° C. with from about 800° C. to about 850° C. being preferred.

The sintered powder is then passed through a high temperature plasma reactor. The specially designed plasma reactors are chosen to insure that each particle has as long a residence time in the plume as necessary to insure complete melting. Conventional, commercially available plasma spray guns used for the creation of plasma sprayed coatings are not as well suited to inflight processing of materials since one of their major design criterion is to produce a high velocity plume, thereby reducing residence time. The powder particles, as they pass through the specially designed reactors are melted and alloyed so that, on cooling, a homogeneous plasma spray powder having the composition described previously for the admixture is produced.

The steps subsequent to the milling, that is, the spray drying, sintering, and passing of the powder through a plasma reactor, by which the particles are melted and then solidified, ensure that the particles are of relatively uniform size and substantially spherical in shape. Thus, they are very desirable for plasma spraying applications. Also, because the specially designed plasma reactors insure complete melting and alloying of the particles prior to being used as a plasma spray powder, the possibility of having an unalloyed particle in the coating due to incomplete melting in the coating operation is eliminated.

The process just described allows for a large yield of particles of the proper size, thereby eliminating the need to reprocess large quantities of out of size material. Any out of size material from the screening operation prior to sintering can be recycled into the subsequent slurry for further spray drying.

The plasma spray powder produced by the above described process consists of substantially spherical, melt solidified particles which are from about 15 to 44 microns in size. Typical weight composition of the powder is from about 10% to about 50% chromium as a first metal, from about 10% to about 20% aluminum as a second metal, from about 0.2% to about 1.5% yttrium as a third metal and the balance a base metal which is preferably nickel, cobalt, iron or mixtures thereof. A preferred weight composition is from about 14% to about 19% chromium. from about 10% to about 14% aluminum, from about 0.5% to about 1.0% yttrium and the balance a base metal.

While there has been shown and described what are at present considered the preferred embodiments of the invention, it will be obvious to those skilled in the art that various changes and modifications may be made therein without departing from the scope of the invention, as defined by the appended claims.

What is claimed is:

1. A process for producing plasma type spray powders, said process comprising:

a. forming an admixture of a base metal and chromium, aluminum, and yttrium powders;

b. milling said admixture by high shearing to produce a homogeneous mixture, or conventional blending if fine starting materials are used;

c. forming a slurry of said homogeneous mixture and an aqueous solution of a binder;

d. spray drying said slurry to produce spray dried agglomerates having a major portion of a particle size of from about 20 to about 53 microns, and a minor portion of the remainder of the agglomerates;

e. separating said major portion of said agglomerates from said minor portion;

f. sintering said major portion in a reducing atmosphere to remove said binder and to produce a homogeneous plasma spray powder.

2. A process according to claim 1 wherein said base metal is selected from the group consisting of nickel, cobalt, iron and mixtures thereof.

3. A process according to claim 2 wherein said admixture consists essentially of, be weight, from about 10% to about 50% chromium, from about 1% to about 20% aluminum, from about 0.2% to about 1.5% yttrium, and the balance base metal.

4. A process according to claim 3 wherein the major portion of said spray dried agglomerates comprises from about 60% to about 90% by weight.

5. A process according to claim 4 wherein said binder is selected from the group consisting of polyvinyl alcohol and polyethylene glycol.

6. A process according to claim 5 wherein the sintering temperature is from about 750° C. to about 900° C.

7. A process according to claim 6 wherein the sintered powder is passed through a plasma reactor and each particle is melted, alloyed, densified and speroidized.

* * * * *